US008374315B2

(12) United States Patent
Freudenberger

(10) Patent No.: US 8,374,315 B2
(45) Date of Patent: Feb. 12, 2013

(54) X-RAY TUBE

(75) Inventor: Joerg Freudenberger, Kalchreuth (DE)

(73) Assignee: Siemens Aktiengesellschaft, Munich (DE)

( * ) Notice: Subject to any disclaimer, the term of this patent is extended or adjusted under 35 U.S.C. 154(b) by 355 days.

(21) Appl. No.: 12/699,486

(22) Filed: Feb. 3, 2010

(65) Prior Publication Data

US 2010/0195800 A1 Aug. 5, 2010

(30) Foreign Application Priority Data

Feb. 3, 2009 (DE) ..... 10 2009 007 217

(51) Int. Cl.
*H01J 35/14* (2006.01)
*H01J 35/06* (2006.01)

(52) U.S. Cl. ..... 378/138; 378/134; 378/136

(58) Field of Classification Search ..... 378/134, 378/136, 138
See application file for complete search history.

(56) References Cited

U.S. PATENT DOCUMENTS 2,896,105 A * 7/1959 Hosemann ..... 378/134
3,882,339 A * 5/1975 Rate et al. ..... 378/124
4,730,353 A * 3/1988 Ono et al. ..... 378/138
5,142,652 A 8/1992 Reichenberger et al.
5,729,583 A * 3/1998 Tang et al. ..... 378/122
6,259,765 B1 7/2001 Baptist
7,512,215 B2 * 3/2009 Morton et al. ..... 378/136
7,903,788 B2 * 3/2011 Moore et al. ..... 378/136
2008/0043920 A1 * 2/2008 Liu et al. ..... 378/138
2008/0187093 A1 * 8/2008 Price et al. ..... 378/19
2009/0003514 A1 * 1/2009 Edic et al. ..... 378/10
2009/0185661 A1 * 7/2009 Zou et al. ..... 378/134

* cited by examiner

*Primary Examiner* — Thomas R Artman
(74) *Attorney, Agent, or Firm* — Schiff Hardin LLP

(57) ABSTRACT

An x-ray tube has an anode and a thermionic emitter with multiple emitter regions spaced from one another that generate, between the emitter and the anode, an electron beam composed of multiple partial beams generated by the respective emitter regions. Between the emitter and the anode is at least one control electrode arrangement that generates a variable electrical field and that has a number of passages to control the respective partial beams. Thus control electrode arrangement has a number of control electrode layers. The individual emitter regions and the control electrodes are arranged and controlled relative to one another to cause substantially the entirety of each partial beam generated by the respective emitter regions to proceed through a passage respectively associated with that partial beam.

5 Claims, 4 Drawing Sheets

X-RAY TUBE

BACKGROUND OF THE INVENTION

1. Field of the Invention

The invention concerns an x-ray tube with a control end arrangement to control an electron beam that is used to generate x-rays in the x-ray tube.

2. Description of the Prior Art

In an x-ray tube, an electron beam is generated with a heatable cathode (also called a thermionic emitter), the electron beam being accelerated toward an anode serving as a target so as to generate x-rays on impact. The intensity of the generated x-ray radiation is thereby determined by the current represented by the electrons, i.e. the electrons striking the anode per time unit. Particularly in computed tomography, it can be necessary to vary the strength of the current formed by the electron beam within a few milliseconds or even microseconds.

This current typically can be controlled by means of temperature changes of the emitter. Although time constants of only a few milliseconds occur for an increase of the current, time constants of over 100 ms occur upon decreasing the current.

As an alternative to this technique, the current can be controlled by the use of a device known as a Wehnelt cylinder. Such a Wehnelt cylinder is a cylindrical control electrode that is mounted in immediate proximity to the emitter and is provided with a negative electrical potential relative to the emitter. By adjusting this potential, the number of electrons that can overcome this potential is varied, and thus the strength of the resulting current is correspondingly varied. Only relatively small currents can be controlled with a Wehnelt cylinder, however, and a significant refocusing of the electron beam by the cylinder occurs.

Grid-shaped control electrode arrangements also offer an additional arrangement for control of the beam current. Such arrangements are known from acceleration technology. A problem with such grid arrangements is that the electrons escaping from the emitter and striking the control electrodes can significantly heat said control electrodes, which can lead to the destruction of the control electrodes. Therefore, such a system operated in a pulsed manner, with the emission times of the emitter amounting to only a few percent of the total operating cycle. For example, given a pulse current of 1 A with an emission time of 1.5% and pulse frequencies in the kHz range, the average current reduces to 15 mA, which is too low for application in computed tomography, for example. Moreover, the control effect of the grid-shaped control electrode arrangement is affected by the high acceleration voltage that is present at the anode and the electrical field caused thereby. This effect of the acceleration voltage on the field caused by the control electrodes is known as the inverse field amplification factor.

SUMMARY OF THE INVENTION

An object of the present invention is to provide an x-ray tube in which the electron beam generated by a thermionic emitter and the current caused by the electron beam can be controlled and the disadvantages cited above are avoided.

This object is achieved by an x-ray according to the invention, having an anode and a thermionic emitter with multiple emitter regions spaced from one another that generate, between the emitter and the anode, an electron beam composed of multiple partial beams respectively generated by the emitter regions. Between the emitter and the anode is a control electrode arrangement that has a number of passages or transmission windows for the partial beams that lie between the individual control electrodes forming the control electrode arrangement, and with which a variable electrical field can be generated to control the partial beams. The control electrode arrangement has multiple control electrode layers that are arranged one after another between the emitter and the anode, and each electrode layer can exhibit a different voltage. The individual emitter regions and the control electrodes are arranged and controllable relative to one another such that each partial beam generated by the individual emitter regions proceeds substantially in its entirety through the passage respectively associated with that partial beam.

In the context of the present application, the term "substantially in its entirety" means that the proportion of the electrons striking the control electrodes is less than 1% of the entire beam and is accordingly practically negligible.

The use of the control electrode arrangement enables the current caused by the electron beam to be controlled—thus to be varied in terms of its strength—by varying a voltage applied to the control electrodes, and therefore a variation of the electrical field caused by this is likewise produced, which affects both the geometry of the electron beam and the number of electrons propagating therein to the anode per time unit (thus the amperage). The potential difference between the emitter and the corresponding control electrodes is the voltage. The aforementioned arrangement of emitter regions and control electrodes also avoids heating of the control electrodes that could ultimately lead to their destruction, since almost all electrons in each partial beam proceed through the respective passages and therefore do not strike the control electrodes. In contrast to the approach known from the aforementioned acceleration technology, continuous operation of the x-ray tube is thus possible.

Since the control electrode arrangement has multiple control electrode systems arranged one after another, a particularly good focusing of the electron beam (and simultaneously a precise control of the current) is possible. Moreover, the field inverse amplification factor of the anode voltage is reduced.

A flat emitter is advantageously used as an emitter since this is particularly suitable to generate high amperages.

In an embodiment wherein control electrode layer is arranged at least approximately in a plane spanned by the emitter regions, a particularly advantageous use of the electrical field caused by the control electrodes to control the current is achieved.

In an embodiment wherein the control electrode layer closest to the electrode has a number of independently controllable control electrodes that can each exhibit a different voltage, partial beams can be individually deflected and a focusing of the individual partial beams can thus be achieved, such that in particular the use of large-area emitters with a particularly high number of emitter regions and partial beams generated by these regions is enabled. A focused electron beam with high amperage thus can be generated.

In order to avoid an influencing the control of the partial beams by the electrical field caused by the anode, thus to minimize the inverse amplification factor, in a preferred embodiment of the invention the ratio of the width of a passage to the distance of a control electrode layer from the emitter is chosen smaller than 1:3. The width of a passage is thereby dimensioned as the separation of two control electrodes perpendicular to the direction of the electron beam within a control electrode layer.

In an embodiment wherein the central beam of a partial beam is aligned to the greatest possible extent parallel to the perpendicular bisectors of the passage associated with this, the electrons emitted from the emitter do not strike the control electrodes and thus almost all of the electrons penetrate through the corresponding passages. This is further ensured when the emitter region is smaller than the projection area of a passage opposite the electrode radiation direction toward the emitter.

DESCRIPTION OF THE PREFERRED EMBODIMENTS

Figure 1:
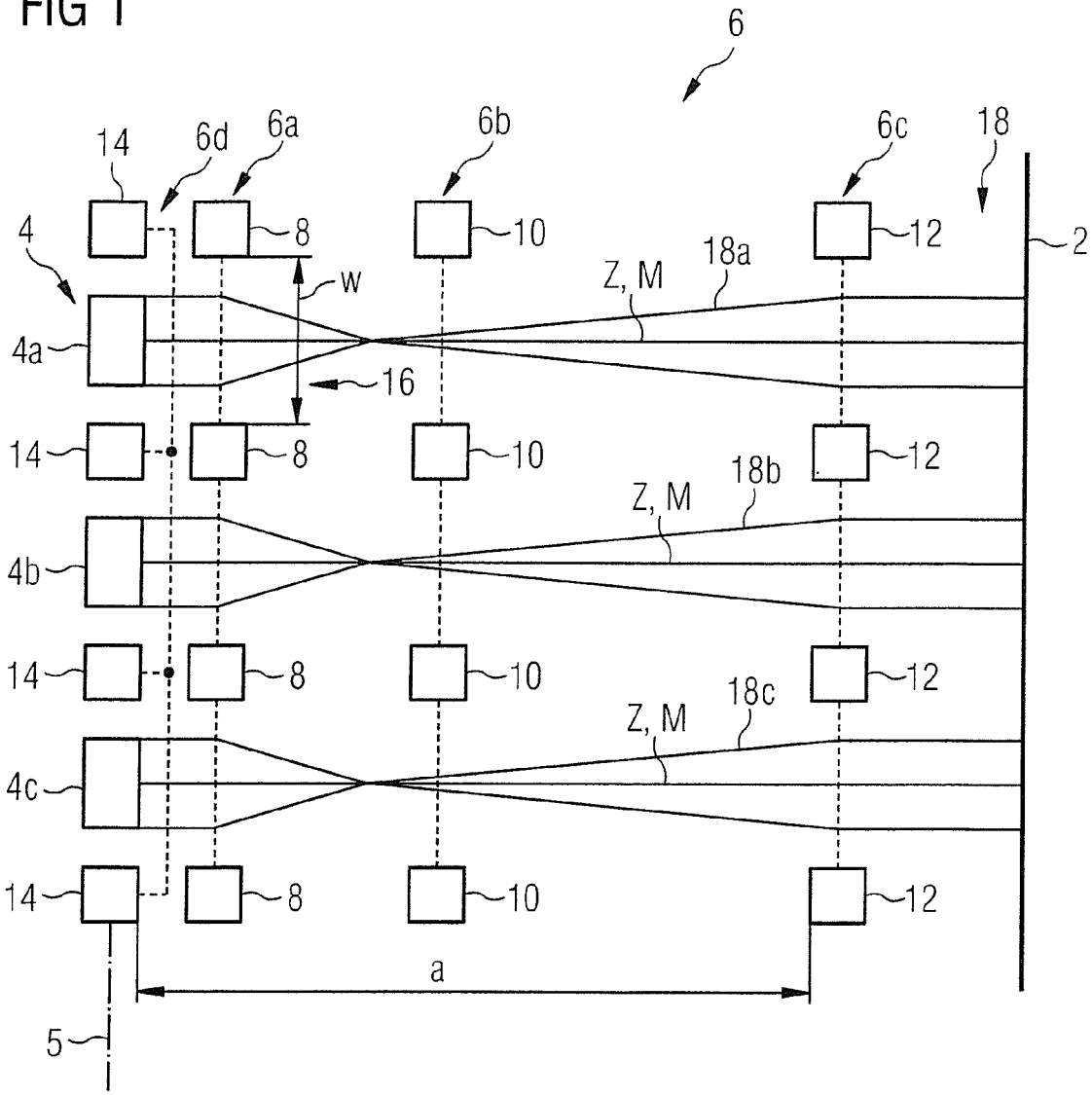
FIG. 1 is a cross section through an x-ray tube according to the invention, in a schematic representation.

According to FIG. 1, an x-ray tube contains an anode 2 as well as a thermionic emitter 4 that in turn in this case comprises three emitter regions 4*a*-4*c* spaced apart from one another and electrically connected in series. Located between emitter 4 and anode 2 is a control electrode arrangement 6 that, in the example, is formed by three control electrode layers 6*a*-6*c* that are successively arranged with increasing distance from one another as viewed from the emitter 4. An additional control electrode layer 6*d* is additionally present in the plane 5 spanned by the emitter regions 4*a*-4*c*. Each control electrode layer 6*a*-6*d* is formed from multiple individual control electrodes 8, 10, 12, 14 that in this simple exemplary embodiment are connected with one another in an electrically conductive manner within the control electrode layer 6*a*-6*d* (illustrated by dashed connection lines) so that the control electrodes 8, 10, 12, 14 of a control electrode layer 6*a*-6*d* respectively exhibit the same voltage U. A penetration window or passage 16 with a width w and a perpendicular bisector M (as is shown for example between two control electrodes 8 of the control end layer 6*a* in FIG. 1) is respectively located between two control electrodes 8, 10, 12, 14. This width w is 0.6 mm in the exemplary embodiment and is the same for all present passages 16 in the exemplary embodiment. The distance a between a control electrode 12 and the emitter 4 that amounts to 3 mm, for example, is also indicated as an example. A ratio of the width of the passages to the separation of the control electrode layer 6*c* (w:a) of 1:5 thus results. The inverse amplification factor of the anode voltage is minimized by such a low ratio.

In operation of the x-ray tube, the emitter 4 and therefore the individual emitter regions 4*a*-4*c* are heated so that these respectively emit a partial beam 18*a*-18*c* of electrons that combine into an electron beam 18. This electron beam 18, namely the individual partial beams 18*a*-18*c* with the respective central beam Z extend from the corresponding emitter regions 4*a*-4*c* through the control electrode arrangement 6 to the anode 2. The individual control electrodes 8 through 14 and the emitter regions 4*a*-4*c* are now arranged relative to one another such that the partial beams 18*a*-18*c* generated by the individual emitter regions 4*a*-4*c* penetrate substantially in their entirety through a passage 16 associated with these, thus do not strike the control electrodes 8, 10, 12, 14. This is also achieved in this case in that the respective central beams Z coincide with the perpendicular bisectors M of the passages 16.

The respective voltage U of the control electrodes 8, 10, 12, 14 can be varied independently so that a variable electrical field is hereby generated. This field also has an effect on the geometry of the individual partial beams 18*a*-18*c*. In the shown exemplary embodiment, the respective control electrodes 8, 10, 12, 14 within a control electrode layer 6*a*-6*d* respectively exhibit the same voltage U while the voltages U of the individual control electrode layers 6*a*-*d* increase from the emitter 4 to the anode 2 as viewed in the beam direction. For example, a voltage U of −1 V is applied to the control electrodes 14, a voltage of 30 V is applied to the control electrodes 8, a voltage of 1000 V is applied to the control electrodes 10 and a voltage of 10000 V is applied to the control electrodes 12 while the emitter 4 exhibits the reference potential of 0 V. To control the current I caused by the electron beam 18, the voltages U applied to the control electrodes 8, 10, 12, 14 can be varied so that these generate a different electrical field and the strength of the current I can hereby be increased or decreased.

Figure 2:
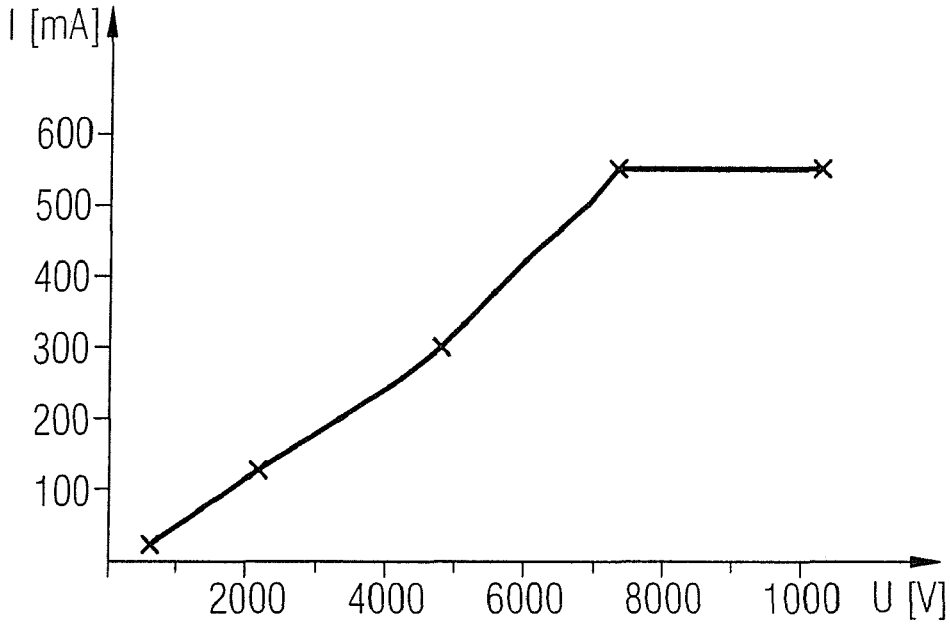
FIG. 2 is a diagram in which the current generated by the electron beam is plotted against the voltage applied to a control electrode layer.

Such a curve of the current I depending on voltage U applied to the control electrode layer 6*c* situated closest to the anode is shown in FIG. 2. It is apparent that the current I caused by the electron beam 18 rises essentially linearly with the voltage U of the control electrode layer 6*c* until it arrives at a saturation value that, in the shown example, is just above 500 mA and is reached given application of a voltage U of 7000 V (for instance) at the control electrode layer 6*c*, while a further increase of the voltage U leads to no further rise of the current I.

Figure 3:
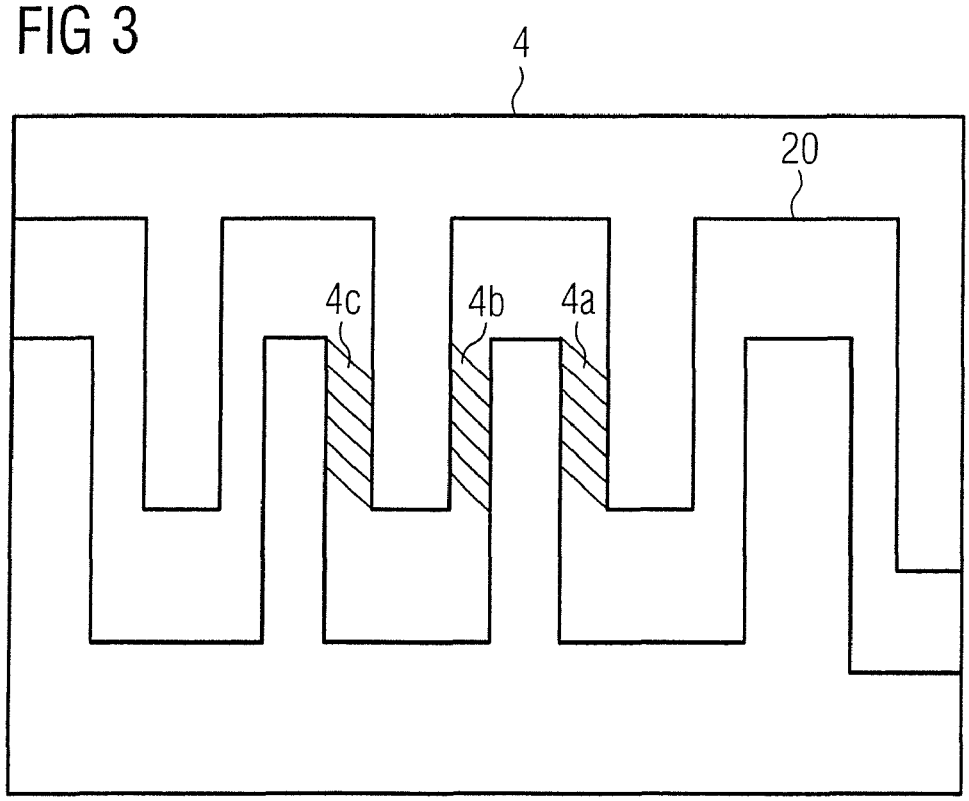
FIG. 3 shows a flat emitter suitable for use in the x-ray tube according to the invention.

The design of an emitter 4 formed from a flat emitter is shown in FIG. 3. This has a serpentine conductor trace 20 that has regions of different widths. Given a current flow through the conductor trace 20, the relatively narrow regions heat up due to the higher resistance prevailing there and can therefore emit electrons. These narrow regions (hatched in FIG. 3) therefore represent the individual emitter regions 4*a*-4*c*. Such an emitter 4 can be produced from a plate, for example with known laser cutting methods.

Figure 4:
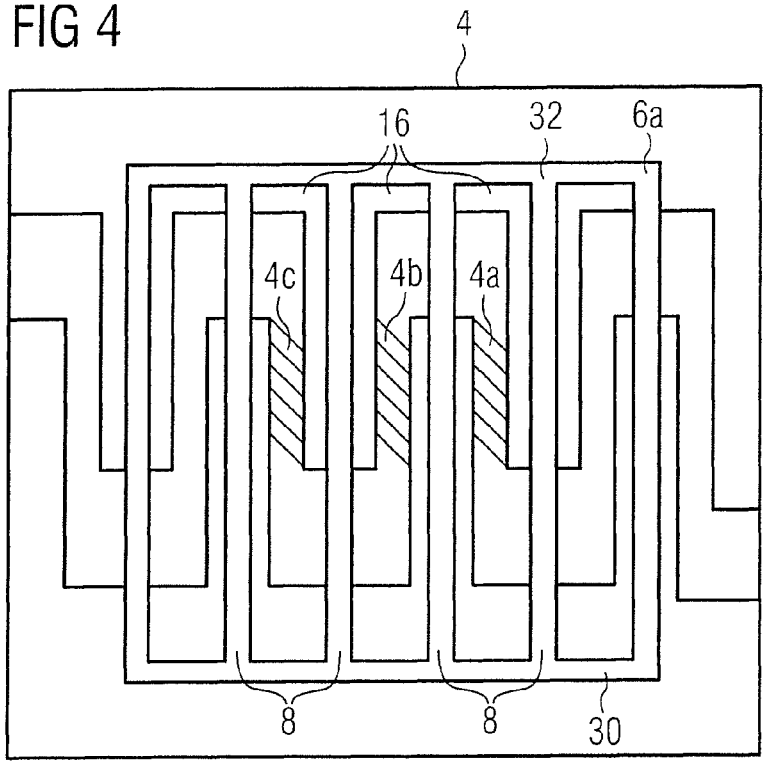
FIG. 4 is a plan view of a control electrode layer in the direction toward the flat emitter.

In FIG. 4, the control electrode layer 6*a* is projected onto the emitter 4 shown in FIG. 3, as viewed from the anode 2 (not shown here). The control electrodes 8 forming the control electrode layer 6*a* are connected with one another in a conductive manner via a web 30, 32 at both of their respective ends so that these always exhibit the same voltage U. The individual emitter regions 4*a*-4*c* are respectively smaller than the projection surface of a passage 16 opposite the electron beam direction at the emitter 4. In connection with the corresponding voltage U of the control electrode layer 6*a* it is thereby ensured that the partial beams 18*a*-18*c* generated by the individual emitter regions 4*a*-*c* penetrate nearly completely through a passage 16 associated with this.

Figure 5:
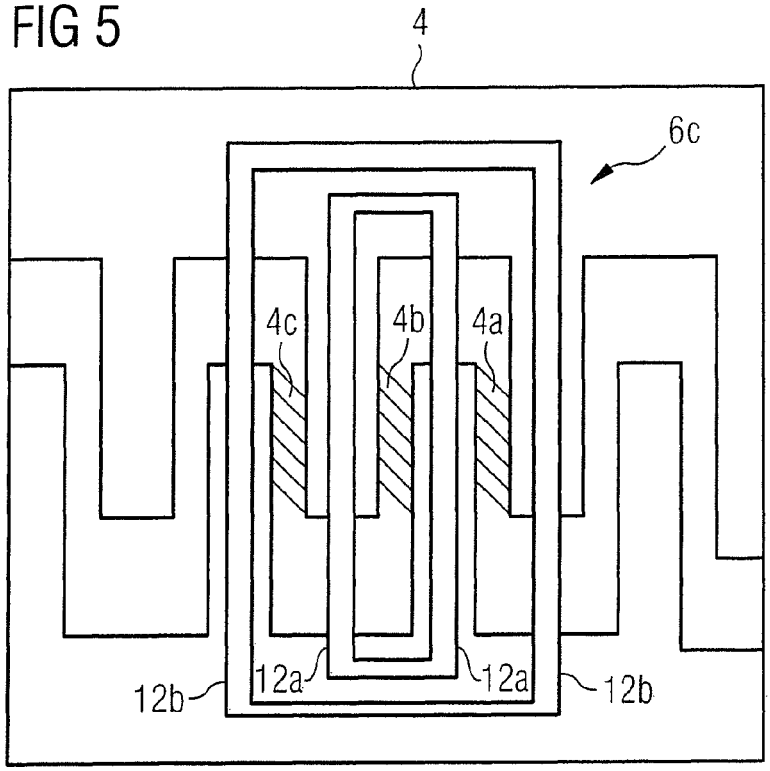
FIG. 5 shows the control electrode layer situated nearest to the anode, likewise viewed in the direction of the flat emitter.

In FIG. 5 the control electrode layer 6*c* situated closest to the anode is now projected opposite to the electron beam direction onto the emitter 4 as it is used in a further embodiment of the invention. However in such a control electrode layer 6*c* all control elements are not connected with one another in a conductive manner as in the preceding example; rather only two control electrodes 12 are. A different voltage U can thus be applied to the two inner control electrodes 12*a* shown in FIG. 5 in comparison to the two outer control electrodes 12*b*. The partial beams 18*a* and 18*c* can thereby be deflected to a different degree than the partial electron beam 18*b*, whereby the individual partial electron beams 18*a*-18*c* can be focused into an electron beam. This is particularly necessary given emitter arrangements of very large area.

Figure 6:
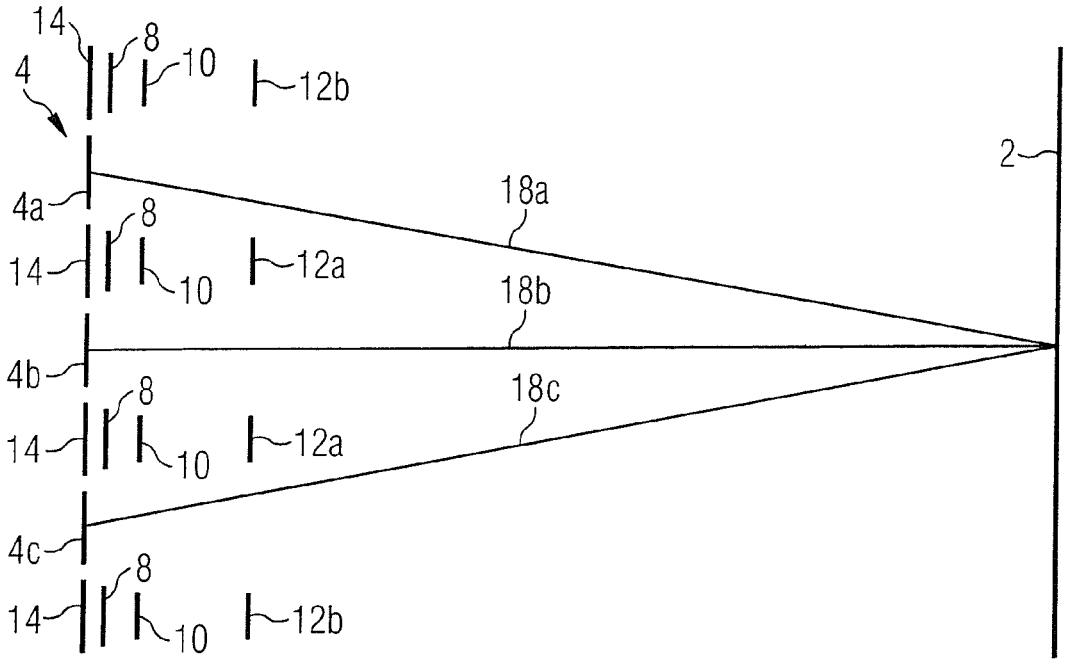
FIG. 6 shows an embodiment of an x-ray tube with a control electrode arrangement in which the partial beams are deflected differently.

Such an x-ray tube in which a number of control electrodes 12 that can be controlled independently of one another within the control electrode layer 6*c* closest to the anode 2, is shown in FIG. 6. for example, a voltage U of 2500 V is applied to the inner control electrodes 12*a* while a voltage U of 2400 V is applied to the outer control electrodes 12*b*. This leads to the situation that the partial beams 18*a* and 18*c* toward the inner control electrodes 12*a* due to the stronger positive charge of said inner control electrodes 12*a*. Partial beam 18*b* is directed through a symmetrical electrical field and does not experience any deflection transversal to the beam direction. The individual partial beams 18*a*-18*c* are thus focused into a resulting electron beam 18.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray tube comprising:

an anode;

a flat thermionic emitter comprising a plurality of emitter regions in a plane of said flat thermionic emitter that are respectively spaced from each other in said plane, said emitter generating an electron beam between said emitter and said anode comprised of a plurality of partial beams respectively generated by said emitter regions;

at least one control electrode arrangement located between said emitter and said anode that generates a variable electrical field and that comprises a plurality of passages therein respectively associated with the respective partial beams, each of said passages controlling the respective partial beam passing therethrough;

said control electrode arrangement comprising a plurality of control electrode layers located in succession between said emitter and said anode, and each of said control electrode layers exhibiting a different voltage and one of said control electrode layers being located in said plane; and said emitter regions and said control electrode arrangement being configured and controlled relative to each other to cause substantially an entirety of each of said partial beams to pass through the passage associated therewith in said control electrode arrangement.

2. An x-ray tube as claimed in claim 1 wherein a control electrode layer among said plurality of control electrode layers, situated closest to the anode comprises a plurality of independent controllable control electrodes that each exhibit a different voltage.

3. An x-ray tube as claimed in claim 1 wherein a ratio of a width of each passage to a distance of the control electrode layer having the passage therein from the emitter, is less than 1:3.

4. An x-ray tube as claimed in claim 1 wherein each partial beam has a central beam oriented substantially parallel to the perpendicular bisector of the passage associated with that partial beam.

5. An x-ray tube as claimed in claim 1 wherein each emitter region is smaller than a projection of the passage associated therewith in a direction toward the emitter.

* * * * *